US007705788B2

(12) United States Patent
Hung et al.

(10) Patent No.: US 7,705,788 B2
(45) Date of Patent: Apr. 27, 2010

(54) MULTI-BAND ANTENNA

(75) Inventors: Chen-Ta Hung, Tu-Cheng (TW); Shang-Jen Chen, Tu-Cheng (TW); Hsien-Sheng Tseng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 175 days.

(21) Appl. No.: 11/825,889

(22) Filed: Jul. 9, 2007

(65) Prior Publication Data

US 2008/0007469 A1 Jan. 10, 2008

(30) Foreign Application Priority Data

Jul. 7, 2006 (CN) ..... 2006 1 0086343

(51) Int. Cl.
*H01Q 1/24* (2006.01)

(52) U.S. Cl. ..... 343/702; 343/700 MS; 343/803; 343/846; 343/853

(58) Field of Classification Search ..... 343/700 MS, 343/846, 853, 895, 702, 803
See application file for complete search history.

(56) References Cited

U.S. PATENT DOCUMENTS 5,847,682 A * 12/1998 Ke ..... 343/752
6,404,395 B1 * 6/2002 Masuda ..... 343/702
6,535,167 B2 * 3/2003 Masuda et al. ..... 343/700 MS
7,057,560 B2 * 6/2006 Erkocevic ..... 343/700 MS
7,218,282 B2 * 5/2007 Humpfer et al. ..... 343/700 MS
7,286,090 B1 * 10/2007 Rowell ..... 343/702
2006/0273977 A1 * 12/2006 Ke et al. ..... 343/795
2008/0238800 A1 * 10/2008 Collins ..... 343/795

FOREIGN PATENT DOCUMENTS

TW 1220581 8/2004

* cited by examiner

*Primary Examiner*—Douglas W Owens
*Assistant Examiner*—Chuc D Tran
(74) *Attorney, Agent, or Firm*—Wei Te Chung; Andrew C. Cheng; Ming Chieh Chang

(57) ABSTRACT

A multi-band antenna used in a portable electrical device can operate in WWAN. The multi-band antenna includes a PCB, a first antenna body, and a second antenna body. The PCB has a first surface and an opposite second surface and defines a through hole extending from the first surface to the second surface. The first antenna body is formed on the first surface of the PCB comprising a first radiating element and a first grounding element. The second antenna body is formed on the second surface of the PCB. The second antenna body comprises a second radiating element, a second grounding element, and a connecting element connecting the second radiating element and the second grounding element. The first radiating element and the second radiating element electrically connect with each other via the through hole of the PCB. A feeding line has an inner conductor electrically connecting to the first radiating element and an outer conductor electrically connecting to the first grounding element.

19 Claims, 4 Drawing Sheets

MULTI-BAND ANTENNA

BACKGROUND OF THE INVENTION

1. Field of the Invention

The present invention relates generally to an antenna, and more particularly to a multi-band antenna comprising a PIFA (Planar Inverted-F Antenna) and a monopole antenna.

2. Description of the Prior Art

With the development of wireless communication, more and more portable electronic devices, such as notebooks, install antenna systems for working in a Wireless Local-area Network (WLAN). Transmitting and receiving signals plays an important role in wireless communication process. In recent years, a majority of WLAN bases on Bluetooth technical standard or 802.11 technical standard. Antenna in Bluetooth technical standard is based on 2.4 GHz frequency band, and in 802.11 technical standard is based on 2.4 GHz and 5 GHz. So, an antenna in a notebook mostly works at the above frequency bands at the present time.

However, more and more people dissatisfy their electronic devices only working in an immovable network (Signal transmission distance is 10 meters in Bluetooth which almost doesn't permit the electronic devices to move.) or a only short-haul movable network (Signal transmission distance is 150 meters of 802.11 technical standard which limits the movement of the electronic device except between work rooms.) of the WLAN. Making the portable electronic devices working in WWAN (Wireless Wide Area) or GPS (Global Positioning System) is a purpose of the many people. Because the portable electronic devices can work or amuse in broaden range in WWAN or GPS. In recent years, WWAN adopts two newly presented technical standards, GSM and CDMA. Operating frequency bands of the GSM and CDMA are 900/1800 MHz, and operating frequency band of the GPS is 1.575 GHz. So, an antenna of a notebook must operate in above frequency bands, the portable electronic device is capable of working in WWAN or GPS. Taiwan patent No. I220581 discloses a PIFA antenna working in 900/1800 MHz. However, the PIFA antenna has relatively big size in height direction. So, many notebooks or other portable electronic devices do not have enough space to install such PIFA antenna. Further more, said PIFA antenna has narrow band and has disturbance between low frequency and high frequency thereof.

Hence, in this art, a multi-band antenna to overcome the above-mentioned disadvantages of the prior art will be described in detail in the following embodiment.

BRIEF SUMMARY OF THE INVENTION

A primary object, therefore, of the present invention is to provide a multi-band antenna with wide frequency bandwidth and suitable to be installed in a notebook or other portable electrical devices with compact size.

In order to implement the above object and overcome the above-identified deficiencies in the prior art, a multi-band antenna adapted for used in a portable electronic device, comprising: a PCB having a through hole; a first antenna body formed on a first surface of the PCB, the first antenna body comprising a first radiating element operating at lower frequency and a first grounding element independent from the first radiating element; and a second antenna body formed on a second surface of the PCB, the second antenna body comprising a second radiating element operating at higher frequency, a second grounding element, and a connecting element connecting the second radiating element and the second grounding element; a feeding line comprising an inner conductor electrically connecting to the first radiating element and an outer conductor electrically connecting to the first grounding element; wherein the first radiating element and the second radiating element electrically connect with each other via the through hole of the PCB.

Other objects, advantages and novel features of the invention will become more apparent from the following detailed description of a preferred embodiment when taken in conjunction with the accompanying drawings.

DETAILEED DESCRIPTION OF THE INVENTION

Reference will now be made in detail to a preferred embodiment of the present invention.

Figure 1:
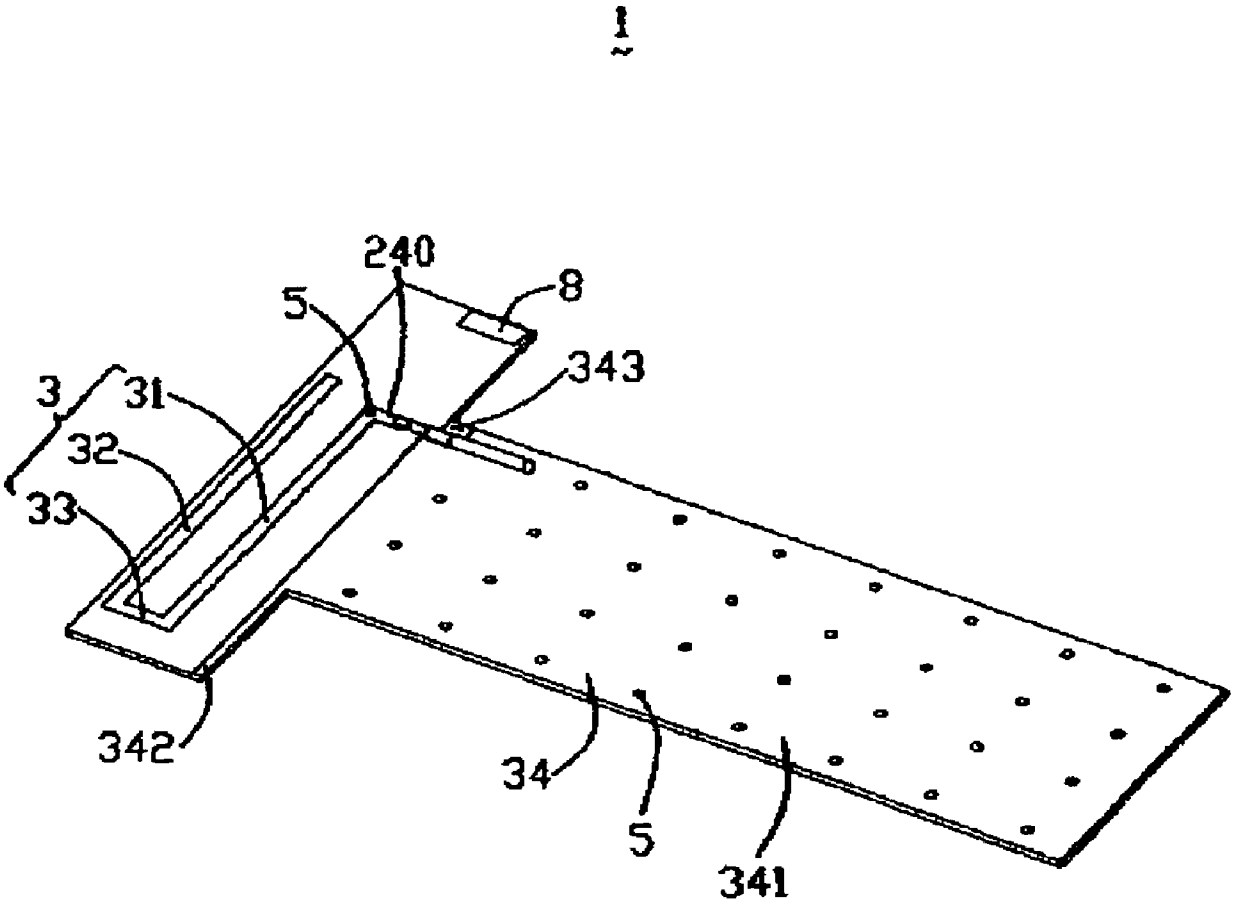
FIG. 1 is a perspective view of a multi-band antenna in accordance with the present invention.
Figure 2:
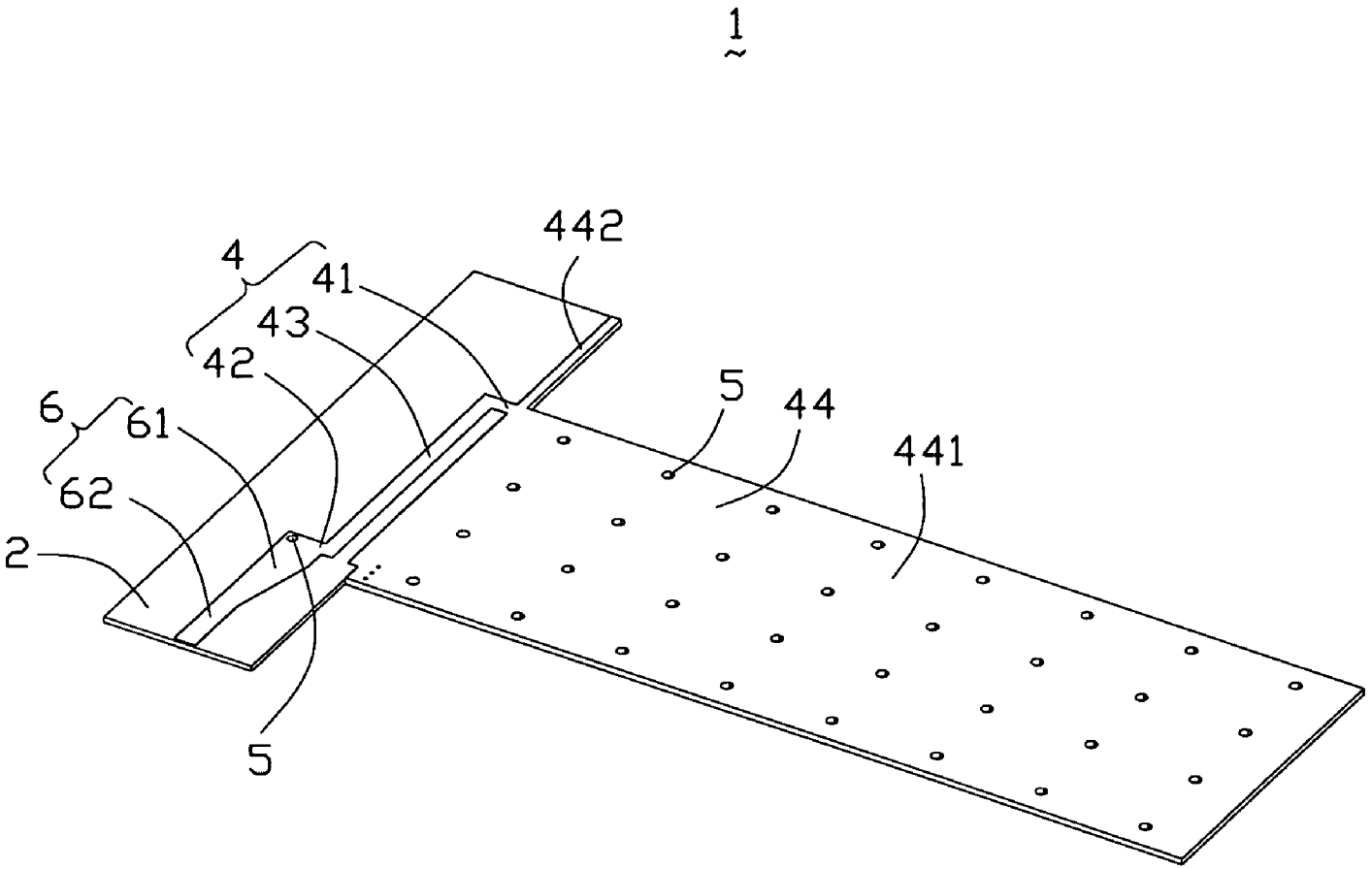
FIG. 2 is a perspective view similar to FIG. 1, but taken from a different aspect.

Referring to FIG. 1 to FIG. 2, a multi-band antenna 1 according to the present invention operates at WWAN (824-960 MHz and 1710-2170 MHz). The multi-band antenna 1 comprises a T-shape PCB (Printed Circuit Board, PCB) 2, a first antenna body (not labeled) formed on a first surface of the PCB 2, and a second antenna body (not labeled) formed on a second surface of the PCB 2.

The first antenna body is a monopole antenna and comprises a first radiating element 3 formed on the upper section of the first surface of the PCB 2, and a first grounding element 34 formed on the lower section of the first surface of the PCB 2 and apart from the first radiating element 3. The first radiating element 3 has an inverted U-shape working at lower frequency (824-960 MHz) and comprises a first radiating arm 31, a second radiating arm 32 parallel to the first radiating arm 31, and a third radiating arm 33 perpendicularly connecting the first radiating arm 31 and the second radiating arm 32. A feeding cap 240 perpendicularly extends from a free end of the first radiating arm 31 toward the first grounding element 34. A through hole 5 is defined in a joint of the first radiating arm 31 and the feeding cap 240. The through hole 5 is plated with conductive material and thus, perpendicularly impenetrates the first antenna body, the PCB 2, and the second antenna body from up-to-down direction.

The first grounding element 34 comprises a rectangular first patch 341 and a first narrow strip 342 extending from a side of the first patch 341 and located at a lowest edge of the upper section of the PCB 2 to be parallel to the first radiating arm 31 of the first radiating element 3. A smaller insulative rectangular patch 8 is attached on the right end of the upper section of the PCB 2 opposite to the first narrow strip 342. A corner of the first patch 341 near the feeding cap 240 is cut for the multi-band antenna 1 achieving good frequency performance in the preferred embodiment. Many through holes 5 are defined in the first patch 341. Each through hole 5 is plated with conductive material and thus, perpendicularly impenetrates the first antenna body, the PCB 2, and the second antenna body from up-to-down direction. A grounding portion 343 is defined at the top edge of the patch 341 opposite to the feeding cap 240.

A feeding line (not shown) has an inner conductor electrically connecting to the feeding cap 240 and an outer conductor electrically connecting to the grounding portion 343.

The second antenna body is a PIFA antenna and comprises a second radiating element 6 formed on an upper section of the second surface of the PCB 2, a second grounding element 44 formed on a lower section of the second surface of the PCB 2 and apart from the second radiating element 6, and a connecting element 4 connecting the second radiating element 6 and the second grounding element 44. The second radiating element 6 operates at higher frequency and comprises a first radiating portion 61 with gradually-increasing-width and a second radiating portion 62 extending from the first radiating portion 61. The first radiating portion 61 can enhance the higher frequency band.

The connecting element 4 is of Z-shape and comprises a first branch 41 extending upwardly from the second grounding element 44, a second branch 43 extending horizontally from the upper free end of the first branch 41 and perpendicular to the first branch 41, and a third branch 42 extending upwardly from the left free end of the second branch 43. The through hole 5 is thus formed in the joint of the connecting element 4 and the first radiating portion 61.

Of course, the feeding line can selectively locate on the first or the second surfaces of the PCB 2. When the feeding line is located on the second surface, the inner conductor of the feeding line electrically connects to the joint of the second branch 42 and the third branch 43 and the outer conductor electrically connects to the second grounding element 44.

The second grounding element 44 comprises a rectangular second patch 441 and a second narrow strip 442 extending from a side of the second patch 441 and located at a lowest edge of the upper section of the PCB 2. The second narrow strip 442 is for the multi-band antenna 1 achieving good frequency performance and is in mirror image of the first narrow strip 342 relative to the PCB 2 in the preferred embodiment. Many through holes 5 are defined in the second rectangle patch 441. Each through hole 5 is plated with conductive material and thus, perpendicularly impenetrates the first antenna body, the PCB 2, and the second antenna body from up-to-down direction.

The first and the second grounding elements 34, 44 of the multi-band antenna 1 achieve good grounding performance in operation. However, if only one grounding element is employed, this also satisfies the need of the multi-band antenna 1 and does not influence the performance of the multi-band antenna 1.

There are a lot of through holes 5 on the PCB 2 for better performance of electrically connecting the first grounding element 34 and the second grounding element 44.

Figure 3:
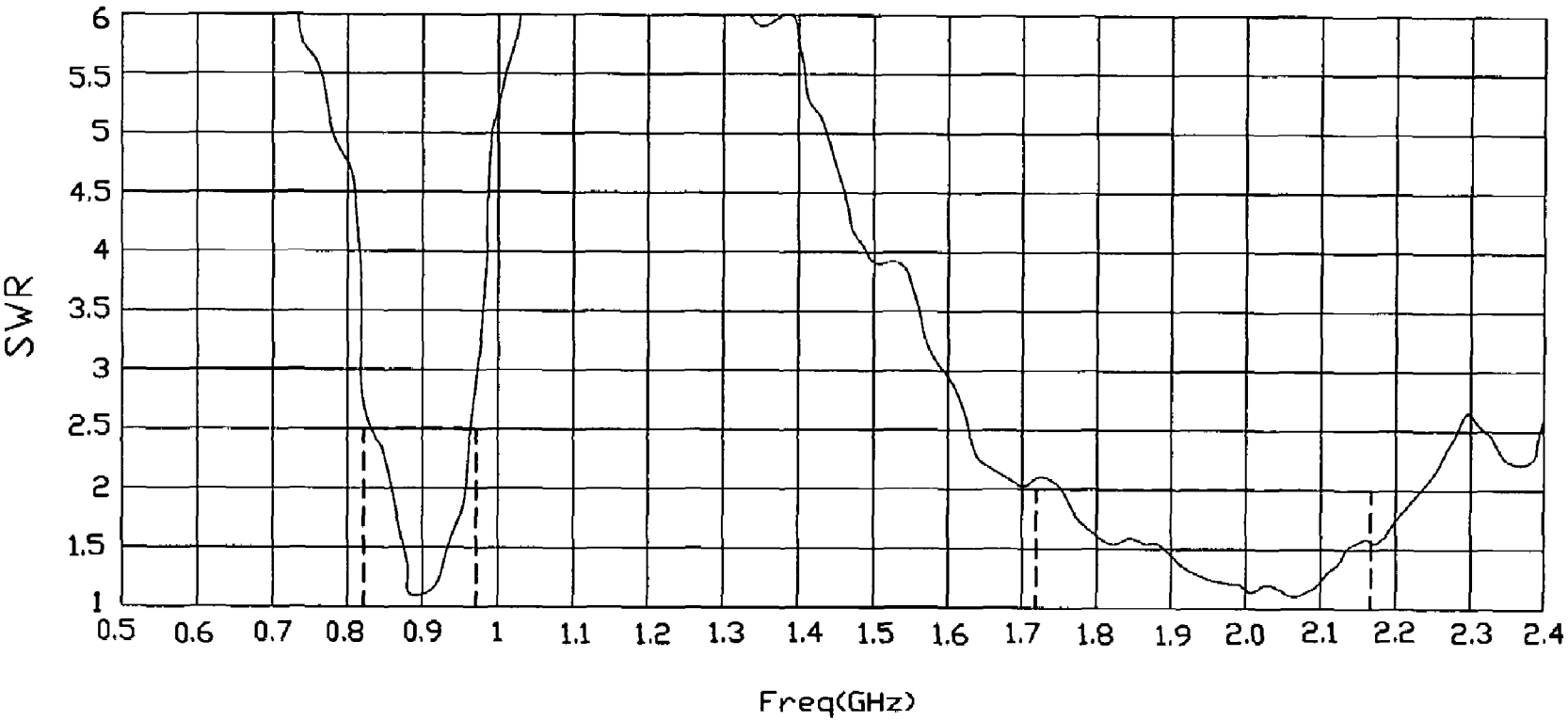
FIG. 3 is a test chart recording of Voltage Standing Wave Ratio (VSWR) of the multi-band antenna as a function of frequency.

Referring to FIG. 3, sets forth a test chart recording of Voltage Standing Wave Radio (VSWR) of the multi-band antenna 1 as a function of frequency. Note that VSWR drops below the desirable maximum value "2" in the 850-960 MHz frequency band and 1750-2240 MHz frequency band, which cover a majority of bandwidth of WWAN (low frequency band includes 824-960 MHz, high frequency band includes 1710-2170 MHz) and be provided with more wider frequency band of the operation at high frequency.

Figure 4:
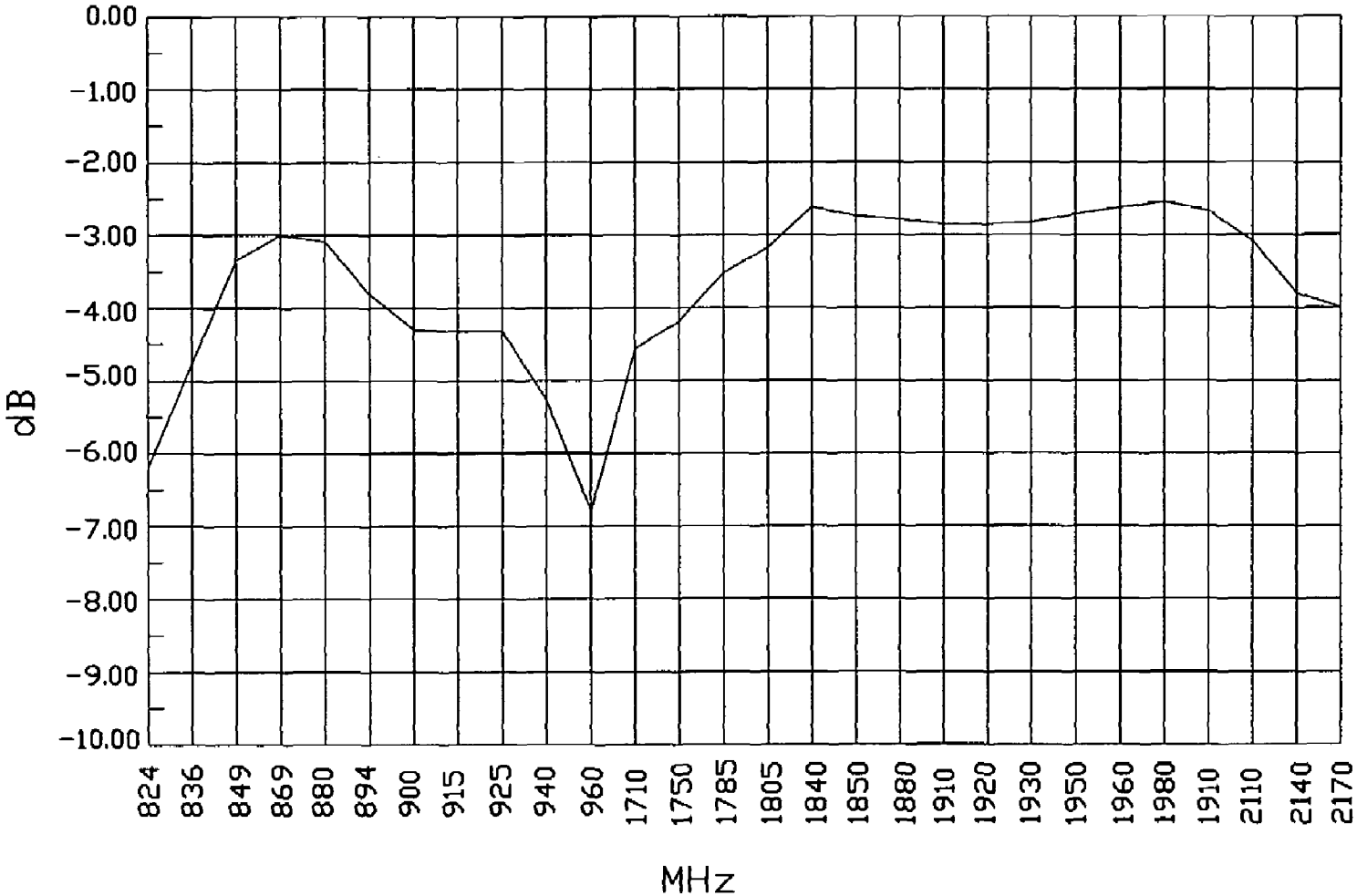
FIG. 4 is a test chart recording of gain of the multi-band antenna as a function of frequency.

The multi-band antenna 1 with two antenna bodies of the present invention has better radiating intension compared with the single antenna body formed on the PCB 2. As well-known, the gain of a monopole antenna is better than a PIFA antenna. The multi-band antenna 1 has desirable gain because the first antenna body is a monopole antenna. Referring to FIG. 4, sets forth a test chart recording of gain of the multi-band antenna 1 as a function of frequency. The gain of the lower frequency band (824-960 MHz) falling into −4 dbi to −7 dbi is better than the traditional PIFA antenna. The gain directly influences the intensity of radiation of an antenna. So, the lower frequency of the multi-band antenna 1 has good intensity of radiation and overcomes disadvantages of the traditional WWAN antenna.

The first radiating element 3 and the second radiating element 6 are respectively defined on the first surface and the second surface of the PCB 2. So, each radiating element 3, 6 has enough space and reduces disturbance of each other.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna adapted for used in a portable electronic device, comprising:

a PCB having a first surface and an opposite second surface and defining a through hole extending from the first surface to the second surface;

a first antenna body formed on the first surface of the PCB, the first antenna body comprising a fist radiating element operating at lower frequency and a first grounding element apart from the first radiating element; and a second antenna body formed on the second surface of the PCB, the second antenna body comprising a second radiating element operating at higher frequency, a second grounding element, and a connecting element connecting the second radiating element and the second grounding element; and a feeding line comprising an inner conductor electrically connecting to at least one of the first radiating element and the second radiating element and an outer conductor electrically connecting to at least one of the first grounding element and the second grounding element; wherein the first radiating element and the second radiating element electrically connect with each other via the through hole of the PCB, the first radiating element, the first grounding element, and the feeding line together compose a monopole antenna.

2. The multi-band antenna as claimed in claim 1, further comprising a plurality of through holes defined in the first grounding element and the second grounding element, each through hole is plated with conductive material and thus, perpendicularly impenetrates the first grounding element, the PCB, and the second grounding element from up-to-down direction to electrically connect the first grounding element and the second grounding element.

3. The multi-band antenna as claimed in claim 1, wherein a feeding cap extends from the first radiating element, and wherein said inner conductor of the feeding line electrically connects to the feeding cap.

4. The multi-band antenna as claimed in claim 1, wherein the first grounding element and the second grounding element each has a narrow strip being arranged on an edge of the PCB and be in mirror image of each other relative to the PCB.

5. The multi-band antenna as claimed in claim 1, wherein the first radiating element of the first antenna body has an inverted U-shape and comprises a first radiating arm, a second radiating arm parallel to the first radiating arm, and a third radiating arm perpendicularly connecting the first radiating arm and the second radiating arm.

6. The multi-band antenna as claimed in claim 1, wherein the monopole antenna operates at 824~960MHz.

7. The multi-band antenna as claimed in claim 1, wherein the second radiating element has a portion with width gradually changing from wide to narrow.

8. The multi-band antenna as claimed in claim 7, wherein the connecting element of the second antenna body has a Z-shape and comprises a first branch perpendicular to the second grounding element, a second branch connecting to the second radiating element, and a third branch perpendicularly connecting the first branch and the second branch.

9. The multi-band antenna as claimed in claim 7, wherein the second radiating element of the second antenna body, the connecting element, and the second grounding element together compose a PIFA antenna.

10. The multi-band antenna as claimed in claim 9, wherein the PIFA antenna operates at 1710~2170MHz.

11. A multi-band antenna adapted for used in a portable electronic device, comprising:

a PCB having a first surface and an opposite second surface and defining a through hole extending from the first surface to the second surface;

a monopole antenna formed on the first surface of the PCB and comprising a first radiating element; and a PIFA antenna formed on the second surface of the PCB and comprising a second radiating element;

a feeding line comprising an inner conductor electrically connecting to at least one of the first radiating element and the second radiating element; wherein the first radiating element and the second radiating element electrically connect with each other via the through hole of the PCB, the first grounding element and the second grounding element each has a narrow strip being arranged on an edge of the PCB and be in mirror image of each other.

12. The multi-band antenna as claimed in claim 11, wherein the monopole antenna comprises a first grounding element apart from the first radiating element, the PIFA antenna comprises a second grounding element electrically connecting with the first grounding element.

13. The multi-band antenna as claimed in 12, further comprising a plurality of through holes defined in the first grounding element and the second grounding element, and wherein each through hole is plated with conductive material and thus, perpendicularly impenetrates the first grounding element, the PCB, and the second grounding element from up-to-down direction to electrically connect the first grounding element and the second grounding element.

14. The multi-band antenna as claimed in claim 11, wherein a feeding cap extends from the first radiating element, said inner conductor of the feeding line electrically connects to the feeding cap.

15. The multi-band antenna as claimed in claim 11, wherein the first radiating element has an inverted U-shape and comprises a first radiating arm, a second radiating arm parallel to the first radiating arm, and a third radiating arm perpendicularly connecting the first radiating arm and the second radiating arm.

16. A multi-band antenna adapted for used in a portable electronic device, comprising:

a PCB having a first surface and an opposite second surface and defining a through hole extending from the first surface to the second surface;

a first antenna formed on the first surface of the PCB and comprising a first radiating element; and a second antenna formed on the second surface of the PCB and comprising a second radiating element; and a feeding line comprising an inner conductor electrically connecting to near one of the first radiating element and the second radiating element; wherein the first radiating element and the second radiating element are configured structurally and functionally different from each other in an asymmetrical manner while electrically connecting with each other via the through hole of the PCB; wherein a first grounding element and a second grounding element are respectively formed on the first surface and the second surface, and the first radiating element is spaced from the first grounding element without any connection while the second radiating element is spaced from the second grounding element via a connection element linked therebetween.

17. The multi-band antenna as claimed in claim 16, wherein there are other through holes formed in said PCB to electrically connecting said first grounding element and said second grounding element.

18. The multi-band antenna as claimed in claim 17, wherein said other through holes are arranged in matrix.

19. The multi-band antenna as claimed in claim 16, wherein the inner conductor of the feeding line is connected to near the first radiating element, and the outer conductor is connected to the first grounding element.

* * * * *